US011022352B2

(12) United States Patent
Khoo

(10) Patent No.: US 11,022,352 B2
(45) Date of Patent: Jun. 1, 2021

(54) EFFICIENCY ENHANCING APPARATUS AND METHODS FOR A HEAT EXCHANGE SYSTEM

(71) Applicant: Cass Khoo, Alameda, CA (US)

(72) Inventor: Cass Khoo, Alameda, CA (US)

( * ) Notice: Subject to any disclaimer, the term of this patent is extended or adjusted under 35 U.S.C. 154(b) by 0 days.

(21) Appl. No.: 14/880,750

(22) Filed: Oct. 12, 2015

(65) Prior Publication Data

US 2016/0102896 A1 Apr. 14, 2016

Related U.S. Application Data

(60) Provisional application No. 62/063,501, filed on Oct. 14, 2014, provisional application No. 62/063,507, filed on Oct. 14, 2014, provisional application No. 62/063,520, filed on Oct. 14, 2014.

(51) Int. Cl.
*F25B 41/00* (2021.01)
*F25B 40/02* (2006.01)

(52) U.S. Cl.
CPC ..... *F25B 41/00* (2013.01); *F25B 40/02* (2013.01); *F25B 2400/0415* (2013.01); *F25B 2400/16* (2013.01)

(58) Field of Classification Search
CPC .... F25B 1/005; F25B 45/00; F25B 2345/002; F25B 41/06; F25B 2400/02; F25B 2400/162; B23P 15/26
USPC ..... 62/509
See application file for complete search history.

(56) References Cited

U.S. PATENT DOCUMENTS 4,136,528 A * 1/1979 Vogel ..... F25B 41/04 62/174
4,735,059 A * 4/1988 O'Neal ..... F25B 41/04 62/196.4
5,259,213 A * 11/1993 Phillippe ..... F25B 13/00 62/160
5,426,956 A * 6/1995 Phillippe ..... F25B 41/00 62/509
5,724,830 A * 3/1998 Otis ..... F25B 41/00 165/109.1
5,727,398 A * 3/1998 Phillippe ..... F25B 41/06 138/40

(Continued)

FOREIGN PATENT DOCUMENTS

WO WO 2010/124153 * 10/2010 ..... F25B 41/00

*Primary Examiner* — Christopher R Zerphey
(74) *Attorney, Agent, or Firm* — Sumana Prabhu

(57) ABSTRACT

A method and apparatus for improving refrigeration and air conditioning efficiency for use with a heat exchange system having a compressor, condenser, evaporator, expansion valve, and circulating refrigerant. The apparatus includes a liquid refrigerant containing vessel having a refrigerant entrance and a refrigerant exit with the vessel positioned in the heat exchange system between the condenser and the evaporator, and means for creating a turbulent flow of liquefied refrigerant. The apparatus further preferably includes a refrigerant bypass path to sub-cool a portion of the refrigerant within the vessel; a disk positioned at the liquid refrigerant entrance to develop a low pressure area on the back side and create a turbulent flow of refrigerant entering the vessel; and a refrigerant valve incorporated into the refrigerant path downstream of the expansion valve and before the coil which develops a vortex that continues through the refrigerant coil.

10 Claims, 8 Drawing Sheets

(56) References Cited

U.S. PATENT DOCUMENTS

| | | | | |
|---|---|---|---|---|
| 6,401,471 | B1 * | 6/2002 | Wightman | F16K 3/0209 236/92 B |
| 6,598,422 | B1 * | 7/2003 | Smith | F25B 41/00 62/509 |
| 9,702,602 | B2 * | 7/2017 | Phillippe | F25B 43/006 |
| 2003/0074910 | A1 * | 4/2003 | Moon | F04C 23/008 62/196.4 |
| 2005/0229622 | A1 * | 10/2005 | Franck | A23G 9/045 62/352 |
| 2007/0144200 | A1 * | 6/2007 | Uchida | F25B 13/00 62/324.4 |
| 2011/0203299 | A1 * | 8/2011 | Jing | F25B 13/00 62/80 |

* cited by examiner (Prior art)

EFFICIENCY ENHANCING APPARATUS AND METHODS FOR A HEAT EXCHANGE SYSTEM

CROSS-REFERENCE TO RELATED APPLICATION

This patent application claims the priority benefit under 35 U.S.C. § 119(e) of U.S. Provisional Applications No. 62/063,501, 62/063,507 and 62/063,520 all filed on Oct. 14, 2014, the contents of which are herein incorporated by reference. This application is related to and incorporates by reference the following commonly assigned patent applications: 2015/0135766, filed Jan. 3, 2015 for Method and apparatus for improving refrigeration and air conditioning efficiency; 2015/0040610, filed Sep. 29, 2014 for Method and Apparatus for improving refrigeration and air conditioning efficiency; 2015/0082819, filed Sep. 29, 2014 for Method and Apparatus for improving refrigeration and air conditioning efficiency; Ser. No. 14/500,477, filed Sep. 29, 2014, for Method and Apparatus for improving refrigeration and air conditioning efficiency; Ser. No. 14/803,456, filed Jul. 20, 2015 for Atomizing device for improving the efficiency of a heat exchange system; Ser. No. 14/803,973 filed Jul. 20, 2015 for Device For Improving the Efficiency of A Heat Exchange System.

FIELD OF THE INVENTION

The present invention relates generally to heat exchange systems and particularly to refrigeration and air conditioning devices. More specifically, an inventive apparatus is disclosed that achieves maximum refrigerant operational conditions while reducing energy consumption by the system.

BACKGROUND OF THE INVENTION

Various devices relying on standard refrigerant recycling technologies have been available for many years, such as refrigeration and heat pump devices, having both cooling and heating capabilities. Within the limits of each associated design specification, heat pump devices enable a user to cool or heat a selected environment or with a refrigeration unit to cool a desired location. For these heating and cooling duties, in general, gases or liquids are compressed, expanded, heated, or cooled within an essentially closed system to produce a desired temperature result in the selected environment.

An expandable-compressible refrigerant is contained and cycled within an essentially enclosed system comprised of various refrigerant manipulating components. When a liquid refrigerant expands (within a heat exchanger or evaporator) to produce a gas it increases its heat content at the expense of a first surrounding environment which decreases in temperature. The heat rich refrigerant is transported to a second surrounding environment and the heat content of the expanded refrigerant released to the second surroundings via condensation (within a heat exchanger or condenser), thereby increasing the temperature of the second surrounding environment. As indicated, even though the subject invention is used preferably with a refrigeration system, adaptation to a generalized heat pump system is also contemplated. Therefore, for a heat pump, heating or cooling conditions are generated in the first and second environments by reversing the process within the enclosed system.

The four basic components in all systems are: a compressor; a condenser (heat exchanger); an evaporator (heat exchanger); an expansion valve; and the necessary plumbing to connect the components. These components are the same regardless of the size of the system. Gaseous refrigerant is compressed by the compressor and transported to the condenser which causes the gaseous refrigerant to liquefy. The liquid refrigerant is transported to the expansion valve and permitted to expand gradually into the evaporator. After evaporating into its gaseous form, the gaseous refrigerant is moved to the compressor to repeat the cycle.

The energy (KW) necessary to operate a cooling or heat exchange system is primarily determined by three factors: the compressor's compression ratio, the refrigerant's condensing temperature and the refrigerant's flow characteristics.

The compression ratio is determined by dividing the discharge pressure (head) by the suction pressure. Any change in either suction or discharge pressure will change the compression ratio. During compression, the refrigerant gas pressure increases and the refrigerant gas temperature increases. When the gas temperature/pressure of the compressor is greater than that of the condenser, gas will move from the compressor to the condenser. The amount of compression necessary to move the refrigerant gas through the compressor is called the compression ratio. The higher the gas temperature/pressure on the condenser side of the compressor, the greater the compression ratio. The greater the compression ratio the higher the energy consumption. The compression ratio should be as low as possible while maintaining operating temperatures to satisfy product requirements. The lower the compression ratio, the higher the volumetric efficiency. The higher the volumetric efficiency, the more mass flow of refrigerant pumped by the compressor leading to greater system capacity and less running time. An added benefit of a lower compression ratio is lower discharge temperatures which in turn leads to less refrigerant oil-breakdown and less contaminants formed by high operating temperatures. A low compression ratio therefore reflects a higher system efficiency and consumes less energy during operation.

It is noted that for refrigeration systems, or any heat pump systems, when pressure calculations are performed they are often made, employing absolute pressure units (PSIA). However, since most individuals skilled in the art of heat pump technologies are more familiar with gauge pressure (PSIG), gauge pressures are used as the primary pressure units in the following exemplary calculations. In a traditional refrigeration system, a typical discharge pressure is 226 PSIG (241 PSIA) and a typical suction pressure is 68 PSIG (83 PSIA). Dividing 226 PSIG by 68 PSIG yields a compression ratio of about 2.9.

The condensing temperature is the temperature at which the refrigerant gas will condense to a liquid, at a given pressure. Well known standard tables relate this data. In a traditional example, using R22 refrigerant, that pressure is 226 PSIG. This produces a condensing temperature of 110 degrees F. At 110 degrees F., each pound of liquid freon that passes into the evaporator will absorb 70.052 Btu's. However, at 90 degrees F. each pound of freon will absorb 75.461 Btu's. Thus, the lower the temperature of the liquid refrigerant entering the evaporator the greater its ability to absorb heat. Each degree that the liquid refrigerant is lowered increases the capacity of the system by about one-half percent.

Well known standard tables of data that relate the temperature of a liquid refrigerant to the power required to move Btu's per hour show that if the liquid refrigerant is at 120 degrees F., 0.98 hp will move 22873 Btu's per hour. If the liquid refrigerant is cooled to 60 degrees F., only 0.2 hp is required to move 29563 Btu's per hour.

Additionally, refrigerant flow through the refrigerant system, in most heat pump systems, is laminar flow. Traditional systems are designed with this flow in mind. However, a turbulent flow is much more energy efficient as is known from well established data tables.

Generally, refrigerant supplied to the evaporator exists in both liquid and vapor form with only a small amount of vapor. To begin with, the refrigerant that enters the expansion valve from the condenser is generally in 100% liquid form at a high temperature of approximately 105 deg C. (corresponding to a pressure of 278 psig). Once it passes through the expansion valve, the pressure and temperature drop drastically (to about 41 deg F.). The sudden drop in temperature causes the boiling point or saturation temperature of the liquid refrigerant to drop. Hence some of the liquid boils off and flashes into vapor (flash gas). The refrigerant entering the evaporator is therefore partially in liquid form with a smaller vapor fraction. The liquid in the evaporator is in an adiabatic state and therefore cannot absorb or reject heat. Only when liquid changes to the vapor state, the refrigerant can absorb heat from the warmer environment that needs to be cooled. The problem is especially true in colder conditions where the refrigerant is not totally vaporized by the time it comes out of the evaporator and a small amount of liquid could go into the compressor. Since liquid cannot be compressed the compressed gets loaded and is ultimately damaged.

For efficient heat transfer through the evaporator coil, it would be beneficial to utilize as much of the evaporator coil area as possible. But the inefficient flow rate through the evaporator leads to inefficient cooling and build-up of frost or ice especially in the initial lower portion of the coil, leading to poor heat conduction through the evaporator coil and inefficient cooling.

The present invention seeks to overcome the foregoing problems by providing an apparatus designed to improve the efficiency of a heat exchange system wherein the refrigerant is sufficiently vaporized before entering the evaporator coils so that the refrigeration mixture has higher vapor content than a normal refrigeration system. Additionally, the apparatus decreases the compression ratio, thereby increasing the efficiency and economy of the system. Further, the apparatus introduces turbulent flow into the liquefied refrigerant within a refrigeration or heat pump system, thus increasing the operational conditions for the refrigerant.

BRIEF SUMMARY OF THE INVENTION

In one aspect of the invention, an apparatus for improving refrigeration and air conditioning efficiency, for use with a heat exchange system (e.g., refrigeration or heat pump devices) is provided having at least a compressor, condenser, evaporator, expansion device, and circulating refrigerant. The efficiency enhancing apparatus comprises a liquid refrigerant containing vessel formed from a cylinder capped by a top end cap and a bottom end cap, wherein the vessel is positioned in the heat exchange system between the condenser and the evaporator. A refrigerant entrance is located in a top region of the vessel and a refrigerant exit is located in a bottom region of the vessel. Preferably, the refrigerant exit is positioned to be no lower than approximately a lowest point in the condenser. The apparatus further includes a first means for delivering refrigerant to the vessel at the entrance and a second means for generating turbulence in the refrigerant exiting the vessel.

In another aspect of the invention, a method of enhancing the efficiency of a heat exchange system having a compressor, condenser, evaporator, a circulating refrigerant, and an expansion device is provided, the method comprising the steps of providing a vessel having a refrigerant entrance and a refrigerant exit and positioned between the condenser and the evaporator, providing a first means to deliver refrigerant to the vessel positioned at the entrance and providing a second means for generating a turbulent flow of the refrigerant at the refrigerant exit.

In yet another aspect of the invention, a heat exchange system with improved efficiency having a compressor, condenser, evaporator, an expansion valve and a circulating refrigerant is provided. The system comprises an efficiency enhancing apparatus positioned between the condenser and the evaporator wherein said apparatus receives a portion of the liquid refrigerant flowing from the condenser. The apparatus includes a first means for delivering refrigerant to the vessel at the entrance and a second means associated with the vessel for generating turbulence in the refrigerant exiting the vessel For example, the first means may comprise a delivery tube configured to generate rotational motion of the refrigerant entering the vessel. In one embodiment, the delivery tube comprises a disk with at least two equally spaced openings to permit passage of entering refrigerant. Preferably, the openings are triangular or semicircular in shape. The disk further includes an orifice at the center configured to allow vaporization of a portion of the liquid refrigerant. In one embodiment, the disk comprises an orifice within a central ring configured to allow vaporization of a portion of the liquid refrigerant, wherein said central ring is supported by connectors connected to an outer ring to define apertures for the direct flow of refrigerant into the vessel. In one embodiment, the disk may include three apertures.

In another example, the first means comprises a bypass tube from the entrance extending into the center of the vessel to sub-cool a portion of the liquid refrigerant within the vessel which terminates in at least one bypass exit port releasing the bypass refrigerant across a heat exchanger, and reintroduces the bypass refrigerant to the refrigerant stream at the bottom of the vessel.

The second means for generating turbulence at the refrigerant exit comprises a set of fixed angle blades positioned in the bottom region of the vessel proximate the refrigerant exit. The blades produce turbulence in the refrigerant as the refrigerant exits the vessel. More particularly, the second means may comprise a disk located proximate the refrigerant exit, a central aperture formed in the disk that permits the passage of exiting refrigerant, and a set of fixed angled blades formed in the disk that project into the central aperture, wherein the set of blades adds turbulence to the exiting refrigerant. In one example, the disc comprises three blades to generate turbulence in the exiting refrigerant.

The heat exchange system includes an atomizer or atomizing device incorporated into the refrigerant path downstream of the expansion valve and before the coil.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3(*b*) is a cross section of the disc positioned at the refrigerant entrance and comprising three apertures. FIG. 3(*c*) shows a top view of the fixed angle blades at the refrigerant exit showing the three blades of the disclosed invention

DETAILED DESCRIPTION OF THE INVENTION

Figure 1:
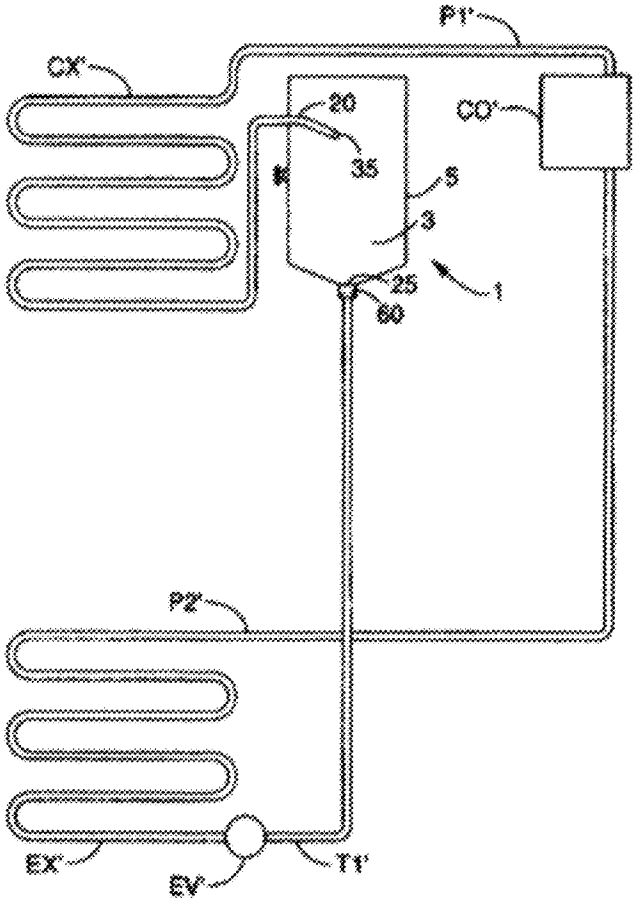
FIG. 1 shows a schematic view of a refrigeration system adapted with the invention disclosed in U.S. Pat. No. 5,426,956.

Referring now to FIG. 1, there is shown a schematic view of a refrigeration system adapted with the invention disclosed in applicant's U.S. Pat. No. 5,426,956. Components of that system include compressor CO; condenser CX; evaporator EX; and expansion valve EV, with the device of the '956 patent fitted into the system between the condenser CX and the evaporator EX. The system stores excess liquid refrigerant (that is normally stored in the condenser) in a holding vessel 1, thus giving an increased condensing volume (usually approximately 20% more condensing volume), thereby cooling the refrigerant more (a type of sub-cooling). By adding this extra cooling the system reduces the discharge pressure and suction pressure. For discharge at P1 the pressure is 168 PSIG (183 PSIA) and for suction at P2 the pressure is 60 PSIG (74 PSIA). With these discharge and suction pressures, the compression ratio calculates to be 2.5. For the traditional refrigeration system, the previously calculated compression ratio was 2.9. This shows a reduction in compression work of about 17%.

Concerning the condensing temperature for the adapted system, the liquid refrigerant temperature at Tl is about 90 degrees F. (lowered from the 110 degrees F. noted above for the traditional system). The 20 degrees F. drop in liquid refrigerant temperature yields a 10% increase in system capacity (20 degrees F. times one-half percent for each degree, as indicated above). This was accomplished by the increased condensing volume provided by the subject device.

The device influences the flow of the liquid refrigerant. Normally, when a vessel is introduced into a fixed pressure system (usually, for sub-cooling) a reduction in the system's capacity occurs because most fixed head pressure systems utilize a fixed orifice or capillary type expansion device. Such devices require pressure to force a proper volume of refrigerant through them in order to maintain capacity. The pressure is generated by the compressor. The greater the demand for pressure the greater the demand for energy (KW).

With the adaptation of a floating head pressure heat pump system by the subject device, the capacity is maintained. The capacity is maintained due to increased refrigerant velocity, volume, and refrigerant Btu capacity because of lower condensing temperature and an introduced spiral turbulent flow, rather than a straight laminar flow. As is well know in fluid dynamics, turbulent flow has an average velocity that is far more uniform than that for laminar flow. In fact, far from being a parabola, as in laminar flow, the distribution curve of the boundary region for a flowing liquid with turbulent flow is practically logarithmic in form. Thus, for turbulent motion, at the boundaries where the eddy motion must reduce to a minimum, the velocity gradient is much higher than in laminar type flow. With the device and its influence on refrigerant flow, the hotter the condensing temperature and the higher the load, the better the adapted system functions.

The vessel 1 has an internal volume 3 and is preferably fabricated from a cylinder 5 and top 10 and bottom 15 end caps of suitable material such a metal, metal alloy, or natural or synthetic polymers. Generally, the top 10 and bottom 15 end caps are secured to the cylinder 5 by appropriate means such as soldering, welding, brazing, gluing, threading and the like, however, the entire vessel 1 may be formed from a single unit with the cylinder 5 and top 10 and bottom 15 end caps as a unitized construction.

A liquid refrigerant entrance 20 and a liquid refrigerant exit 25 penetrate the vessel 1. Preferably, the refrigerant entrance 20 is located in a top region of the vessel 1. The top region is defined as being approximately between a midline of the cylinder 5, bisecting the cylinder 5 into two smaller cylinders, and the top end cap 10. Although FIG. 1 depicts the refrigerant entrance 20 as penetrating the cylinder 5, the entrance may penetrate the top end cap 10. Preferably, the refrigerant exit 25 is located in a bottom region of the vessel 1. The bottom region of the vessel 1 is defined as being approximately between the midline, above, and the bottom end cap 15. Although other locations are possible, the refrigerant exit 25 is preferably located proximate the center of the bottom end cap 15.

Usually, the bottom end cap 15 has an angled or sloping interior surface 30. However, the bottom end cap 15 may have an interior surface of other suitable configurations, including being flat.

Liquid refrigerant liquefied by the condenser CX enters into the vessel 1 via the refrigerant entrance 20 and the associated components. The associated entrance components comprise a refrigerant delivery tube 35 and entrance fitting 40 that secures the vessel 1 into the exit portion of the plumbing coming from the condenser CX. The entrance fitting 40 is any suitable means that couples the subject device into the plumbing in the required position between the condenser CX and the evaporator EX.

The refrigerant delivery tube 35 is configured to generate rotational motion in the entering refrigerant. The tube 35 penetrates into the top region and is formed into a curved configuration and generally angled down to deliver the entering refrigerant along a path suitable for generating a rotational motion of the refrigerant within the vessel 1.

To view the level of the liquid refrigerant within the vessel 1, a sight glass 45 is provided. The glass 45 is mounted in the cylinder 5 at a position to note the refrigerant level.

The refrigerant exit 25 is comprised of an exit tube and fitting 50 that secures the subject device into the plumbing of the system. The exit fitting 50 is any suitable means that couples the subject device into the plumbing in the required position between the condenser CX and the evaporator EX.

A second means for introducing a turbulent flow into the exiting liquefied refrigerant is mounted proximate the exit 25. A "turbulator" 60 is held in place by cooperation between the exit tube and fitting 50 or any other equivalent means. The turbulator is usually a separate component that is secured within the components of the exit from the vessel 1, however, the turbulator may be an integral part of the vessel 1 refrigerant exit. The turbulator comprises a disk with a central aperture and at least one fixed angle blade formed or cut into the disk. Preferably, a set of fixed angle blades are provided to add turbulence to the exiting refrigerant.

The blades are angled to induce rotational, turbulent motion of the liquid refrigerant as the refrigerant exits the vessel 1. Various angles for the blades are suitable for generating the required turbulence.

Preferably, the subject vessel 1 is placed in the adapted system so that the refrigerant exit 25 is no lower than the lowest portion of the condenser CX. Liquid refrigerant from the condenser CX enters the vessel 1 and is directed into a swirling motion about the interior volume 3 by the delivery tube 35. The swirling liquid refrigerant leaves the vessel 1 by means of the refrigerant exit 25 and then encounters the turbulator 60. The blades of the turbulator 60 add additional turbulence into the flow of the refrigerant.

Figure 2:
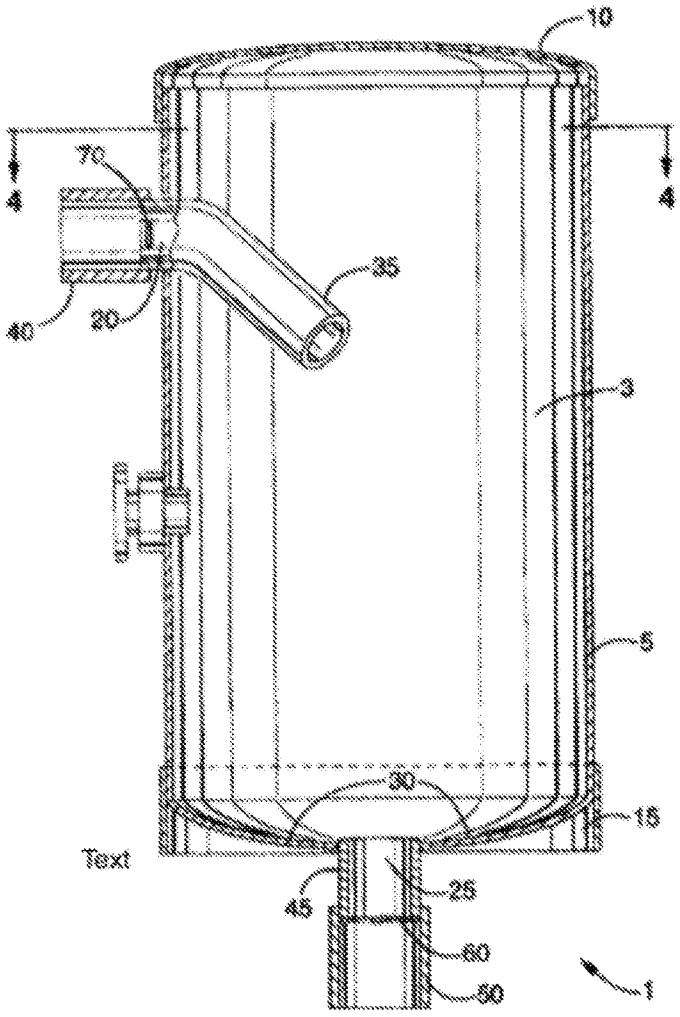
FIG. 2 shows a schematic view of an embodiment of the invention showing the delivery tube angled to generate rotational motion of the incoming refrigerant and a disc with at least two apertures positioned at the entrance.
Figure 3A:
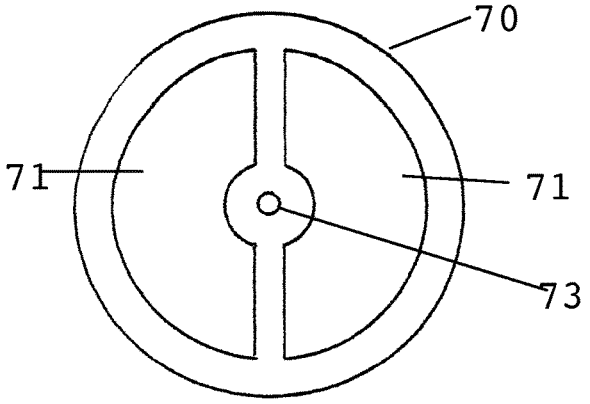
FIG. 3(*a*) shows a cross sectional view of the disc at the refrigerant entrance with two apertures.
Figure 3B:
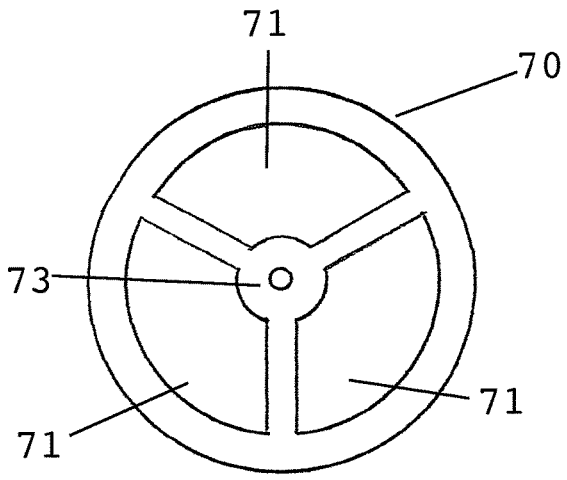
Figure 3C:
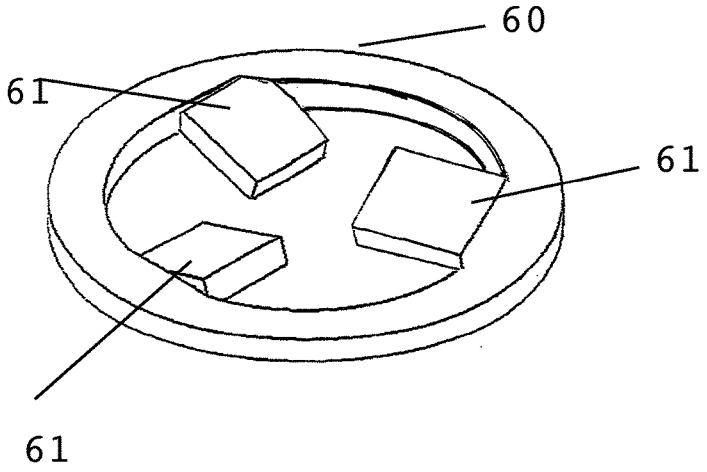

FIG. 2 is an embodiment of the inventive apparatus, used to sub-cool a portion of the refrigerant within the vessel 1. A refrigerant delivery tube 35 is configured to generate rotational motion in the entering refrigerant. The tube 35 located at the entrance of the vessel 1 has a curved configuration and is angled downwards to generate rotational motion of the refrigerant within the vessel 1. Other equivalent configurations of the tube 35 that generate such a rotational refrigerant motion are contemplated to be within the realm of the invention. A disk 70 is positioned at the liquid refrigerant entrance 20 and connected to the delivery tube 35. As shown in FIG. 3*a* the disk comprises an orifice within a ring 73 supported by connectors to outer ring 70 to define semicircular shaped apertures, 71, the orifice 73, at the center of the disk to allows vaporization of a portion of the liquid refrigerant. Preferably, the disk may comprise three triangular apertures as shown in FIG. 3(*b*).

Figure 4:
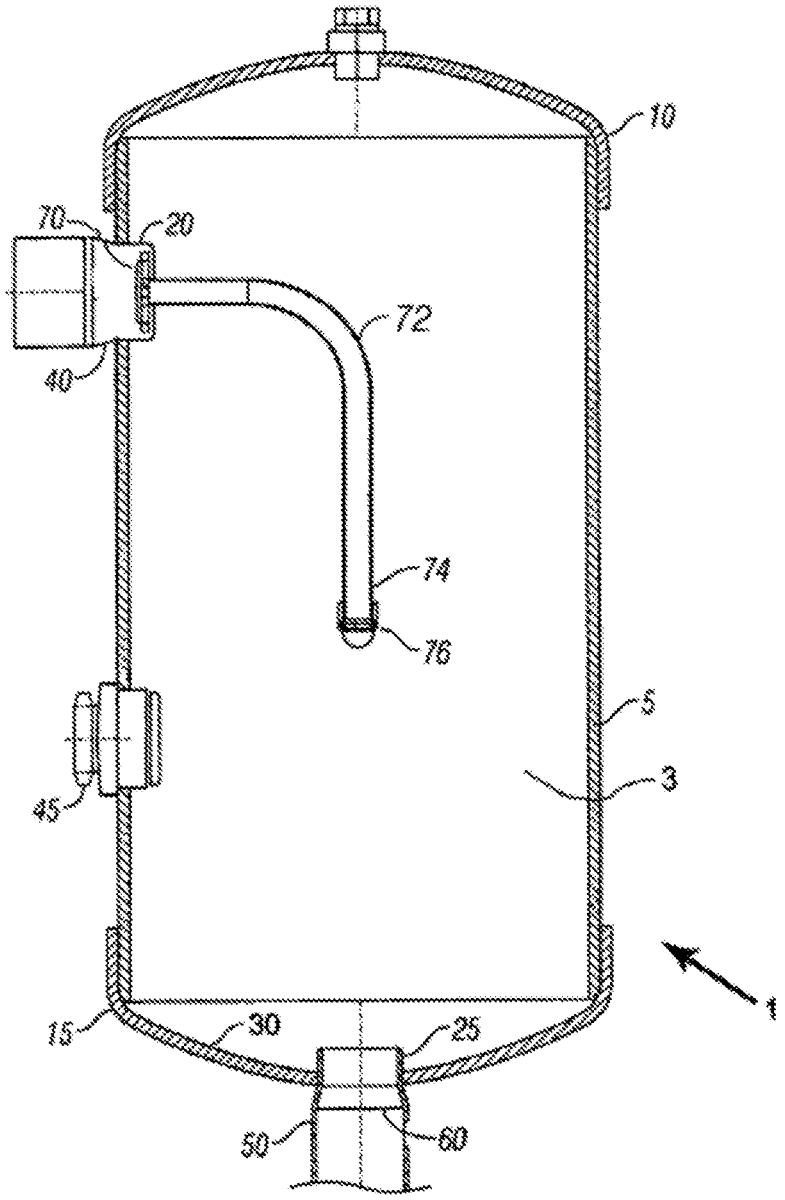
FIG. 4 shows a schematic view of an embodiment of the inventive apparatus with the bypass tube passing through the entrance of the vessel and a disk located at the entrance.
Figure 5:
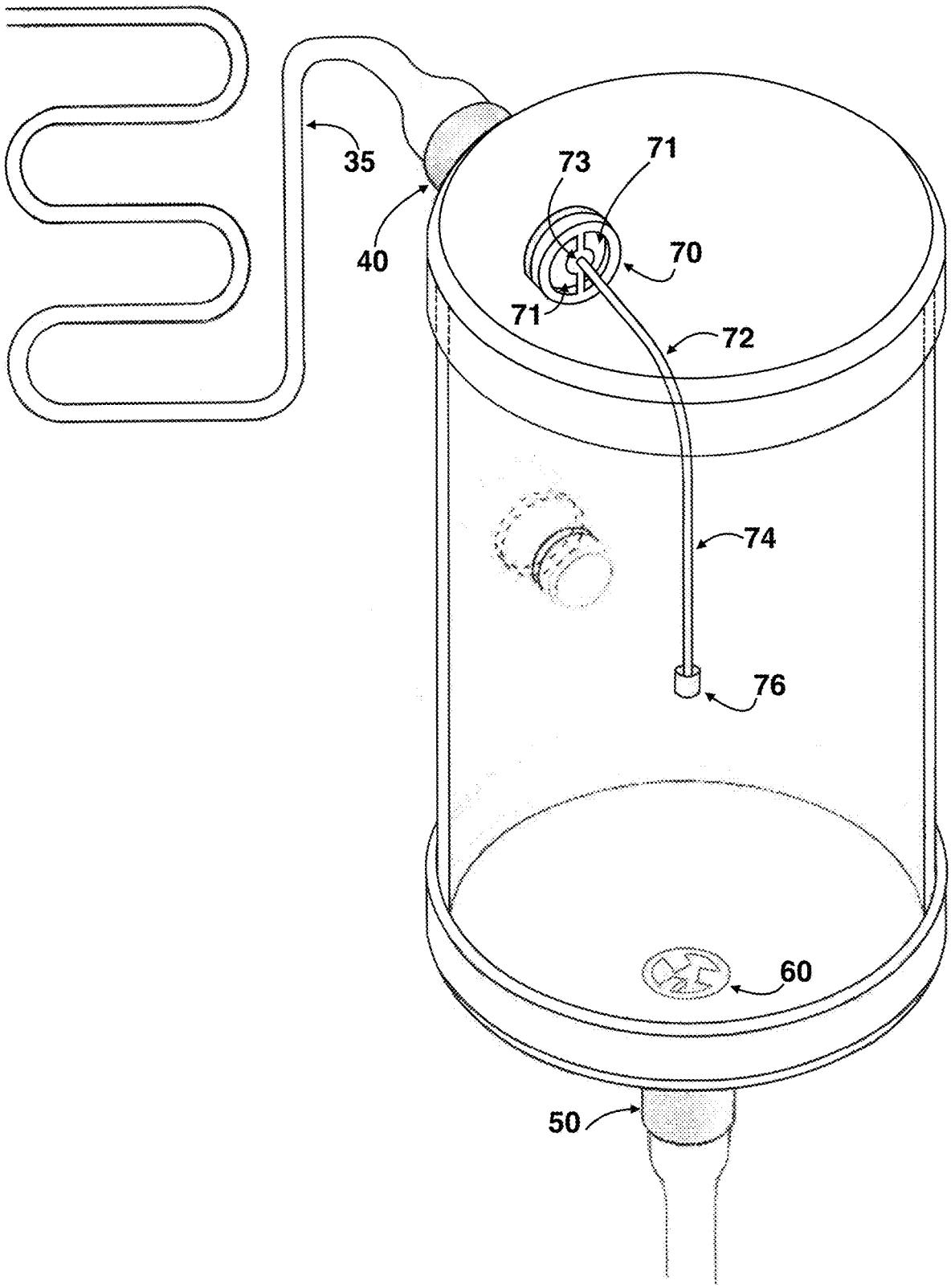
FIG. 5 is 3-dimensional view of the an embodiment of the disclosed invention.

FIG. 4 shows yet another embodiment of the inventive apparatus. Refrigerant from the condenser enters vessel 10 through a disk 70 positioned at entrance 20. FIG. 3(*a*) is a cross sectional view of the disk. The disk comprises apertures 71 for direct flow of refrigerant from the condenser into the vessel. A tube 72 (herein referred to as bypass tube) passes through a small opening, 73 at the center of the disc. The tube 72 is referred to as a 'bypass tube' since a small portion of the refrigerant passes through it. Most of the refrigerant entering the vessel from the condenser pipe 35, passes through apertures 71 which are much larger compared to the opening 73 of the bypass tube. FIG. 5 is a 3-dimensional view of the inventive apparatus. The disk 70 with three apertures is clearly indicated. The disk develops a low pressure area on the back side and creates a turbulent flow of the refrigerant entering the vessel, thereby improving refrigerant efficiency.

A turbulator 60 is positioned at the exit comprising a disk with a central aperture and at least one fixed angle blade formed or cut into the disk. Preferably, three fixed angle blades 61 are provided to add turbulence to the exiting refrigerant (FIG. 3(*c*)).

After the refrigerant enters the vessel and starts to exit, it develops a shallow-well vortex at the bottom of the vessel 1. In the center of the shallow-well vortex, it develops a low-pressure area. The stronger the vortex, which increases as it becomes hotter, the greater the low-pressure area in the center of the vortex, thereby being able to sub-cool the refrigerant that passes over the heat exchanger 76 at the bottom of the delivery tube 72.

With the development of the low-pressure area in the center of the vortex, the small amount of refrigerant entering the liquid refrigerant entrance 20 expands and comes out at the exit port 74 to sub-cool the refrigerant and allow the heat bubbles carried by the refrigerant to continue to condense so as to allow the refrigerant that is delivered downstream to the expansion valve to have less non-condensed refrigerant within it, thereby improving the operation of the system.

Figure 6:
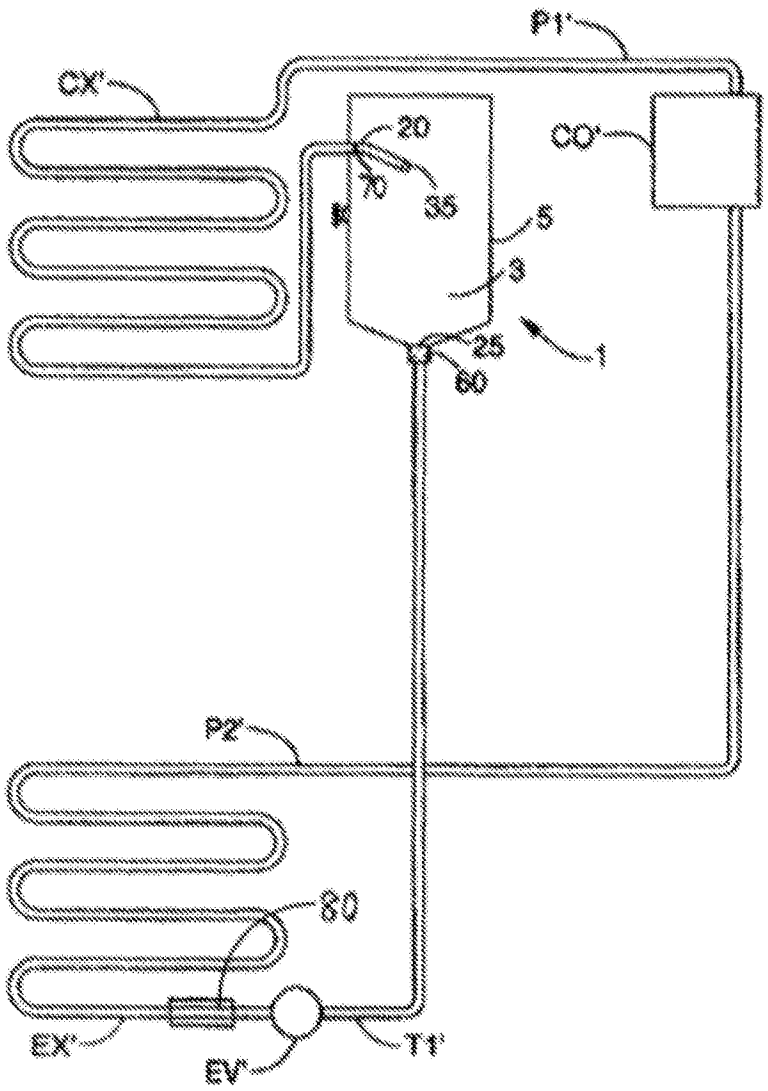
FIG. 6 shows a schematic view of the heat exchange system according to an embodiment of the invention showing the delivery tube

FIG. 6 is a representation of the heat exchange system with the compressor, condenser, the evaporator and the inventive apparatus positioned between the condenser and the evaporator. In preferred embodiment, the system may include an atomizer 80 incorporated into the refrigerant path downstream of the expansion valve and before the evaporator coils, details of which have been described in the applicant's previous applications PCT/US15/41096 and PCT/US15/41148. The atomizer preferably comprises a circular disk within a system of copper pipes. The disc has at least two vertical blades that are at an angle to the disc which help create and maintain a spiral turbulent flow as the refrigerant vapor flows through the atomizer disc in the pipe. This develops a vortex that continues through the refrigerant coil, ensuring uniform flow through the coil to increase coil efficiency and reduce refrigerant pooling. Alternatively, instead of an atomizing disc a cylindrical screen coated with diamonds may be used details of which have been described in an earlier filed application by the applicant No. PCT/US15/41148.

Figure 7:
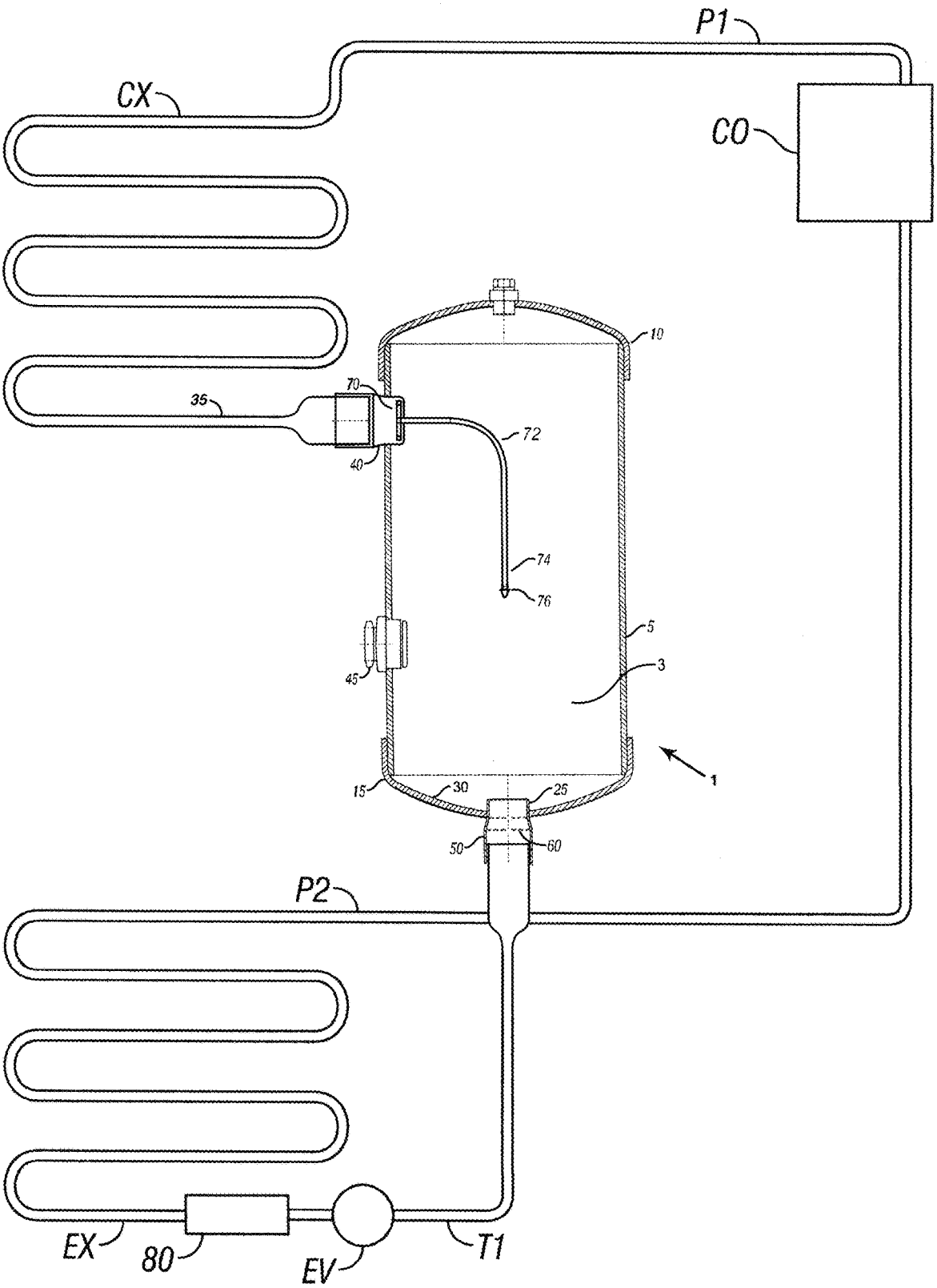
FIG. 7 shows a schematic view of the heat exchange system according to another embodiment of the invention with a bypass tube passing through the entrance of the vessel.
Figure 8:
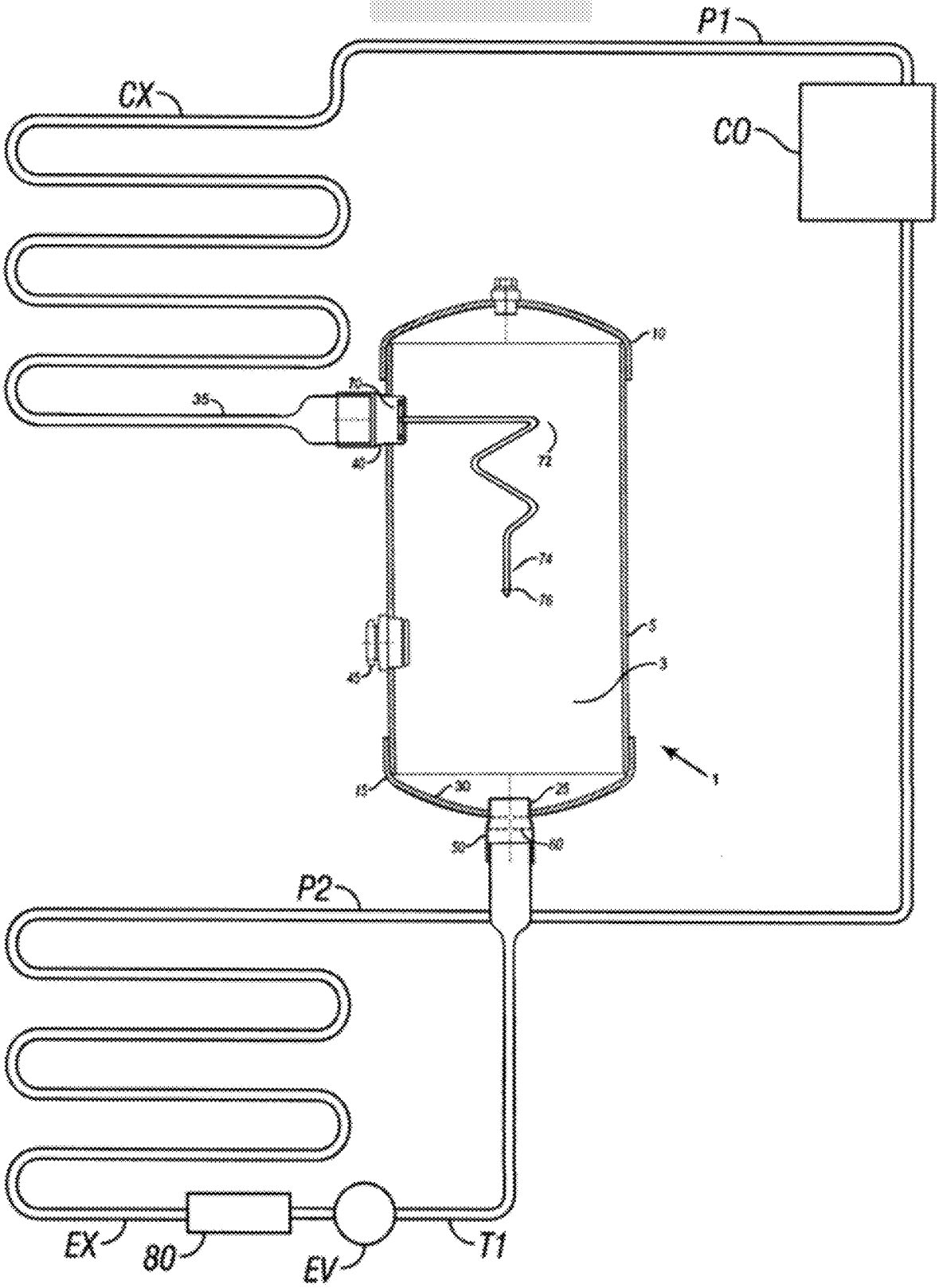
FIG. 8 shows a schematic view of the heat exchange system with a spiral shaped bypass tube.

FIG. 7 is a heat exchange system which includes another embodiment of the inventive apparatus comprising the bypass tube. The bypass tube can have other configurations, for e.g. a spiral configuration as shown in FIG. 8.

With the addition of the efficiency enhancing apparatus with adiabatic sub-cooling, it is possible to tune a refrigeration system using an adjustable thermostat expansion valve. Just as the thermostat expansion valve adjusts to varying conditions at the evaporator, this condenser control allows the condenser to be adjusted under varying conditions as well.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

We claim:

1. An apparatus for enhancing the efficiency of a heat exchange system having a compressor, condenser, evaporator, a circulating refrigerant and an expansion valve, said apparatus comprising:

a vessel having a refrigerant entrance and a refrigerant exit, wherein said vessel is positioned between the condenser and the evaporator;

a refrigerant delivery tube angled to produce rotational motion of incoming refrigerant;

a first disk positioned at the entrance and within the delivery tube, said first disk comprising an orifice within a central ring configured to allow vaporization of a portion of the liquid refrigerant; wherein said central ring is supported by connectors connected to an outer ring to define apertures for the direct flow of refrigerant into the vessel; and a means associated with said vessel to create turbulent flow of refrigerant exiting said vessel.

2. The apparatus of claim 1, wherein said means for creating turbulence comprises a second disk located proximate said refrigerant exit, said second disk permitting the passage of exiting refrigerant; and at least one fixed angle blade formed in said disk, wherein said blade adds turbulence to the exiting refrigerant.

3. The apparatus of claim 2, wherein said second disk comprises three fixed angle blades formed in said second disk.

4. A method of enhancing the efficiency of a heat exchange system having a compressor, condenser, evaporator, a circulating refrigerant, and an expansion valve, said method comprising the steps of:

providing a vessel between the condenser and the evaporator wherein said vessel has a refrigerant entrance and a refrigerant exit;

providing a refrigerant delivery tube at the entrance angled to provide rotational motion of entering refrigerant;

positioning a first disk inside the delivery tube said first disk comprising an orifice within a central ring configured to allow vaporization of a portion of the liquid refrigerant; wherein said central ring is supported by connectors connected to an outer ring to define apertures for the direct flow of refrigerant into the vessel; and providing a means to create a turbulent flow of the refrigerant at the refrigerant exit.

5. The method of claim 4, wherein said means for creating turbulence comprises a second disk located proximate said refrigerant exit, said second disk permitting the passage of exiting refrigerant; and at least one fixed angle blade formed in said second disk, wherein said blade adds turbulence to the exiting refrigerant.

6. The method of claim 5, wherein said means comprises three fixed angle blades formed in said second disk.

7. A heat exchanger system with improved efficiency having a compressor, condenser, evaporator, an expansion valve and a circulating refrigerant, said system further comprising:

an efficiency enhancing apparatus positioned between the condenser and the evaporator; said efficiency enhancing apparatus comprising: a vessel having a refrigerant entrance and a refrigerant exit; a refrigerant delivery tube located at the entrance, configured to generate rotational motion of the refrigerant entering said vessel; a first disk positioned at the entrance and within the delivery tube, said first disk comprising an orifice within a central ring configured to allow vaporization of a portion of the liquid refrigerant; wherein said central ring is supported by connectors connected to an outer ring to define apertures for the direct flow of refrigerant into the vessel; and a means associated with said vessel to create turbulent flow of refrigerant exiting said vessel.

8. The heat exchanger system of claim 7, wherein said means for creating turbulence comprises a second disk located proximate said refrigerant exit, said second disk permitting the passage of exiting refrigerant; and at least one fixed angle blade formed in said second disk, wherein said blade adds turbulence to said exiting refrigerant.

9. The heat exchanger system of claim 8, wherein said means comprises three fixed angle blades formed in said second disk.

10. A method for enhancing the efficiency of a heat exchange system having a compressor, condenser, evaporator, a circulating refrigerant and an expansion valve; said method comprising the steps of:

compressing the refrigerant in the compressor to form a compressed gas refrigerant;

passing the compressed refrigerant into a condenser to form a liquid refrigerant;

allowing the liquid refrigerant exiting said condenser to flow into a vessel positioned between the condenser and evaporator;

generating rotational motion of refrigerant entering said vessel;

allowing a portion of the entering refrigerant to expand through a first disk, said first disk comprising an orifice within a central ring configured to allow vaporization of a portion of the liquid refrigerant; wherein said central ring is supported by connectors connected to an outer ring to define apertures for the direct flow of refrigerant into the vessel; and generating turbulent flow of refrigerant exiting said vessel.

* * * * *